US010654077B2

(12) United States Patent
Wang

(10) Patent No.: US 10,654,077 B2
(45) Date of Patent: May 19, 2020

(54) DUAL-PURPOSE ROTATING SPRAY GUN FOR DUST REMOVAL AND CLEANING

(71) Applicant: Gen Chong Wang, Yongkang (CN)

(72) Inventor: Gen Chong Wang, Yongkang (CN)

( * ) Notice: Subject to any disclaimer, the term of this patent is extended or adjusted under 35 U.S.C. 154(b) by 188 days.

(21) Appl. No.: 15/820,501

(22) Filed: Nov. 22, 2017

(65) Prior Publication Data

US 2019/0015876 A1 Jan. 17, 2019

(30) Foreign Application Priority Data

Jul. 17, 2017 (CN) ..... 2017 2 0863523 U

(51) Int. Cl.

| | |
|---|---|
| ***B08B 3/02*** | (2006.01) |
| ***B05B 3/04*** | (2006.01) |
| ***B05B 7/24*** | (2006.01) |
| ***B05B 12/00*** | (2018.01) |
| ***B08B 1/00*** | (2006.01) |
| ***B08B 5/02*** | (2006.01) |
| *B05B 3/06* | (2006.01) |
| *B05B 15/62* | (2018.01) |

(52) U.S. Cl.

CPC ..... *B08B 3/026* (2013.01); *B05B 3/0427* (2013.01); *B05B 7/2424* (2013.01); *B05B 12/002* (2013.01); *B08B 1/002* (2013.01); *B08B 3/028* (2013.01); *B08B 5/02* (2013.01); *B05B 3/06* (2013.01); *B05B 7/2435* (2013.01); *B05B 15/62* (2018.02); *B08B 2203/0217* (2013.01); *B08B 2203/0229* (2013.01)

(58) Field of Classification Search

CPC ..... B08B 3/026

See application file for complete search history.

(56) References Cited

U.S. PATENT DOCUMENTS

2010/0176219 A1* 7/2010 Hasegawa ..... B05B 3/00 239/407
2014/0008457 A1* 1/2014 Bosua ..... B05B 3/04 239/104
2015/0000705 A1* 1/2015 Dehn ..... B08B 3/028 134/21

* cited by examiner

*Primary Examiner* — Jason Y Ko
(74) *Attorney, Agent, or Firm* — HYIP

(57) ABSTRACT

The utility model discloses a dual-purpose rotating spray gun for dust removal and cleaning, comprising a gun body (1), a trigger switch (2), a pot body assembly and a rotating spray apparatus, wherein the rotating spray apparatus comprises a bidirectional connector (3), a spray nozzle (4), a connecting sheath (7), a hollow rotating shaft (5), a rotating spray head (10), a spray pipe (9) and a cleaning solution suction pipe (13); one end of the bidirectional connector (3) is fixed to an air passage outlet of the gun body (1); the other end is fixed to the connecting sheath (7); the hollow rotating shaft (5) is arranged in the connecting sheath (7); the spray nozzle (4) is fixed to an outlet of the bidirectional connector (3); the spray head of the spray nozzle (4) is matched with the hollow rotating shaft (5); the rotating spray head (10) is fixed to the hollow rotating shaft (5) and is provided with a rotating spray track (18); the spray pipe (9) is fixed to the rotating spray track (18); an inlet of the spray pipe (9) is communicated with the hollow rotating shaft (5); and an outlet of the spray pipe (5) is positioned on an outer end surface of the rotating spray head (10). After the structure is adopted, the utility model has the characteristics of simple structure, convenient production and processing, stable quality, low operating conditions, good dust removal and cleaning effects, long life and the like.

9 Claims, 6 Drawing Sheets

DUAL-PURPOSE ROTATING SPRAY GUN FOR DUST REMOVAL AND CLEANING

TECHNICAL FIELD

The utility model relates to a cleaning tool, and in particular to a dual-purpose rotating spray gun for dust removal and cleaning capable of being used for dust removal and cleaning.

BACKGROUND

For the convenience of dust removal and cleaning of automobiles or workpieces, a dust removal function and a cleaning function of a used cleaning tool are required to exchange. For example, a Chinese patent 2012202121308 applied by an applicant discloses a dual-purpose gun for dust removal and cleaning. The structure comprises a gun body, a trigger switch and a cleaning solution storage pot. A hollow shaft is fixed to a gun head of the gun body. A head of the hollow shaft is provided with a rotating spray pipe which can freely rotate. A horn-shaped spray head is fixed to the hollow shaft. The horn-shaped spray head covers the hollow shaft and the rotating spray pipe. An air passage of the gun body, the hollow shaft and the rotating spray pipe form a spray passage. A cleaning solution suction pipe is arranged in the rotating spray pipe. After penetrating through the hollow shaft, the cleaning solution suction pipe is communicated with the cleaning solution storage pot. When compressed air is used in the structure, the compressed air sprayed from the spray head eliminates granule dust or dirt on automobile or workpiece surfaces. Meanwhile, when the compressed air and the cleaning solution are used, the cleaning solution is sucked out by negative pressure through the compressed air and sprayed to a dirt part at high pressure for decontamination.

However, the dual-purpose gun for dust removal and cleaning in the above structure has the following defects during use: 1. The rotating spray pipe is bent and formed repeatedly by a metal hard pipe; requirements for processing precision are very high; bending radian and angle are slightly biased; during installation and use, rotating speed and deflection angle may be affected and even the dual-purpose gun cannot be used, so processing difficulty is large and a scrap rate is high. 2. Use requirements are high; the rotating spray pipe cannot be touched during operation; if the rotating spray pipe is deformed, a slight result is that rotating speed and deflection angle are affected and cleaning speed and quality are directly affected; and a serious result is that the rotating spray pipe is not rotated and cannot be used. To this end, many manufacturers and people of vision specially conduct development and manufacture, but no ideal product emerges so far.

SUMMARY

To overcome the above defects in the existing dual-purpose gun for dust removal and cleaning, the purpose of the utility model is to provide a dual-purpose rotating spray gun for dust removal and cleaning with simple and reasonable structure, convenient production and processing, stable and reliable quality, high yield, low operating conditions and long product life.

The utility model adopts a technical solution to solve the above technical problems. The dual-purpose rotating spray gun for dust removal and cleaning comprises a gun body, a trigger switch, a pot body assembly and a rotating spray apparatus, wherein the rotating spray apparatus comprises a bidirectional connector, a spray nozzle, a connecting sheath, a hollow rotating shaft, a rotating spray head, a spray pipe and a cleaning solution suction pipe; one end of the bidirectional connector is fixed to an air passage outlet of the gun body; the other end is fixed to the connecting sheath; the hollow rotating shaft is rotatably arranged in the connecting sheath; the spray nozzle is fixed to an outlet of the bidirectional connector; the spray head of the spray nozzle is inserted into the hollow rotating shaft; the rotating spray head is fixed to the hollow rotating shaft and is provided with a rotating spray track; the spray pipe is fixed to the rotating spray track; an inlet of the spray pipe is communicated with the hollow rotating shaft; an outlet of the spray pipe is positioned on an outer end surface of the rotating spray head; and the cleaning solution suction pipe is arranged in the spray pipe, penetrates through the hollow rotating shaft and the spray nozzle and is connected with a housing assembly.

In a further solution of the utility model, a cleaning connector sleeved on the rotating spray head is fixed to the connecting sheath; and the end surface of the rotating spray head is provided with a synchronously rotating fan structure.

In a further solution of the utility model, an angle at which a connecting line between a center extension line of an inlet end of the spray pipe and a center of an outlet end of the spray pipe deviates from a vertical line is controlled between 16 degrees and 26 degrees.

In a further solution of the utility model, the cleaning connector is a horn-shaped connector, and a brush is fixed to the horn-shaped connector.

In a further solution of the utility model, bearings are correspondingly arranged on both ends of the hollow rotating shaft; one end of the hollow rotating shaft is provided with a retaining ring which is used for compressing the bearing (6); and the bearing on the other end of the hollow rotating shaft is fixed through a compression nut fixed to the connecting sheath.

In a further solution of the utility model, the pot body assembly comprises a pot body, a pot cover fixed to the pot body, a valve and a suction pipe connector; one end of the valve is fixedly connected with an air passage of the gun body through the suction pipe connector; and the other end is fixed to the pot cover and is connected with a weighted dip tube.

After the above structure is adopted, compared with the prior art, the utility model has the following advantages and effects: 1. the rotating spray head and the hollow rotating shaft can freely rotate in the connecting sheath, thereby realizing high rotating speed, accurate positioning of cleaning points, good cleaning quality, high efficiency and effortless and convenient cleaning during operation. 2. Because the rotating spray track is arranged on the rotating spray head, the spray pipe made by flexible material is simple, effortless and convenient in installation, and the product can be ensured to realize consistency, stable quality and high yield. 3. Because the spray pipe is fixed to the rotating spray head, the spray pipe is difficult to be damaged during use and then operating conditions are greatly reduced. 4. Because the fan structure is arranged on the end surface of the rotating spray head, an atomization effect can be further enhanced during cleaning and operating environments can be improved during dust removal.

In the Figures: 1 gun body; 2 trigger switch; 3 bidirectional connector; 4 spray nozzle; 5 hollow rotating shaft; 6 bearing; 7 connecting sheath; 8 compression nut; 9 spray pipe; 10 rotating spray head; 11 cleaning connector; 12 brush; 13 cleaning solution suction pipe; 14 suction pipe connector; 15 valve; 16 pot cover; 17 pot body; 18 rotating spray track; 19 fan structure; and 20 weighted dip tube.

DETAILED DESCRIPTION

Figure 1:
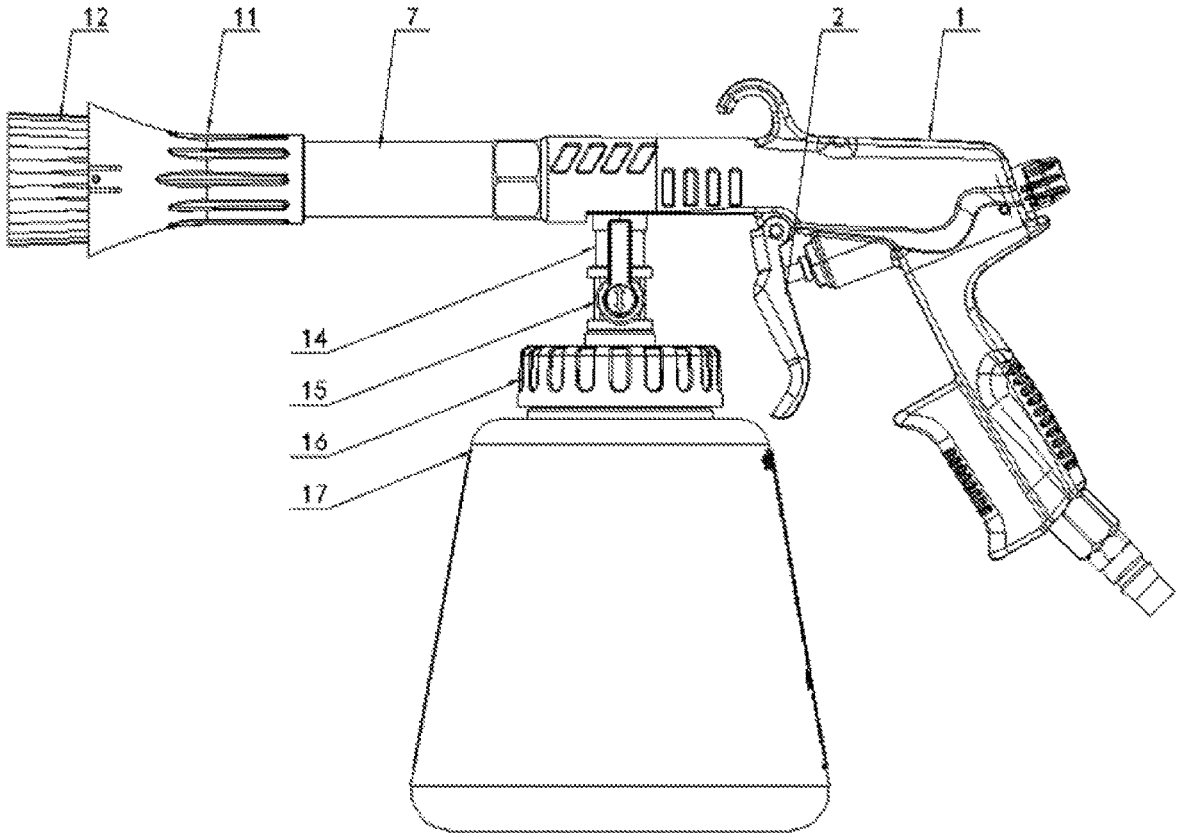
FIG. 1 is a schematic diagram of a main structure of the utility model.
Figure 2:
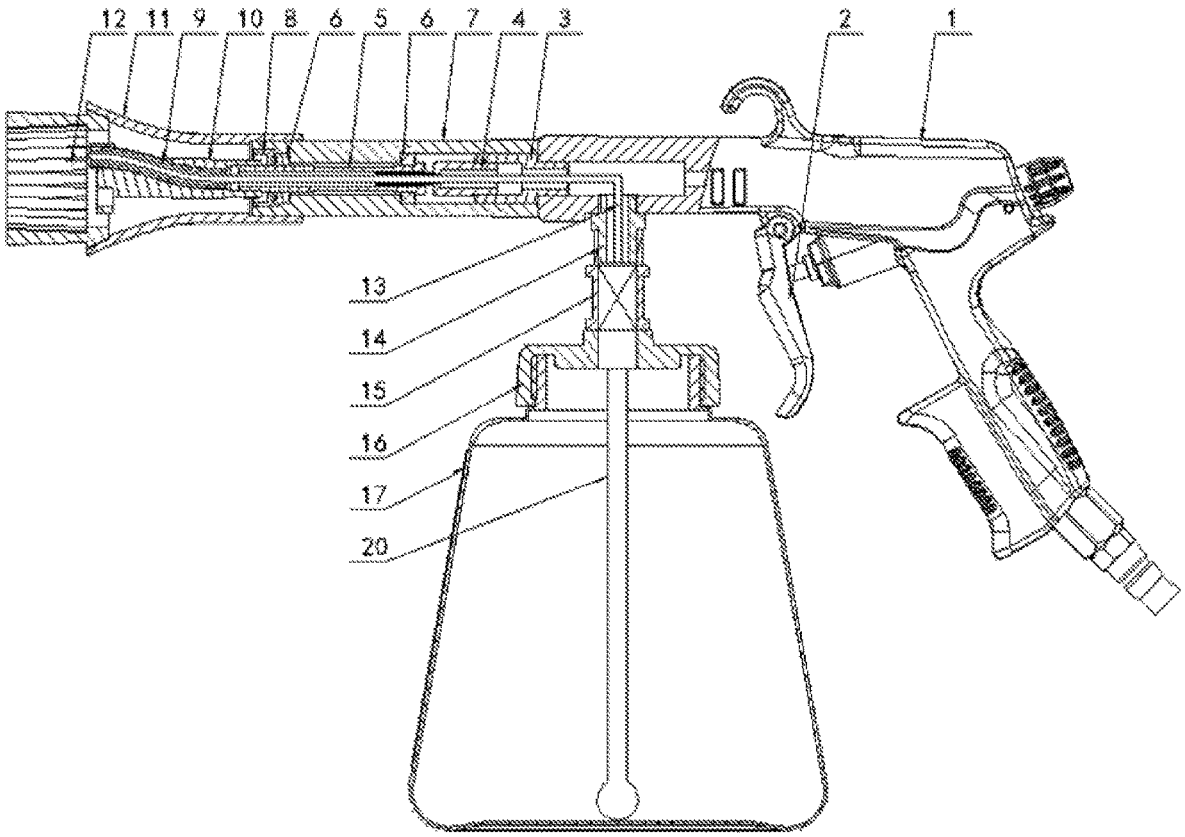
FIG. 2 is a schematic diagram of a matching structure of the utility model.
Figure 3:
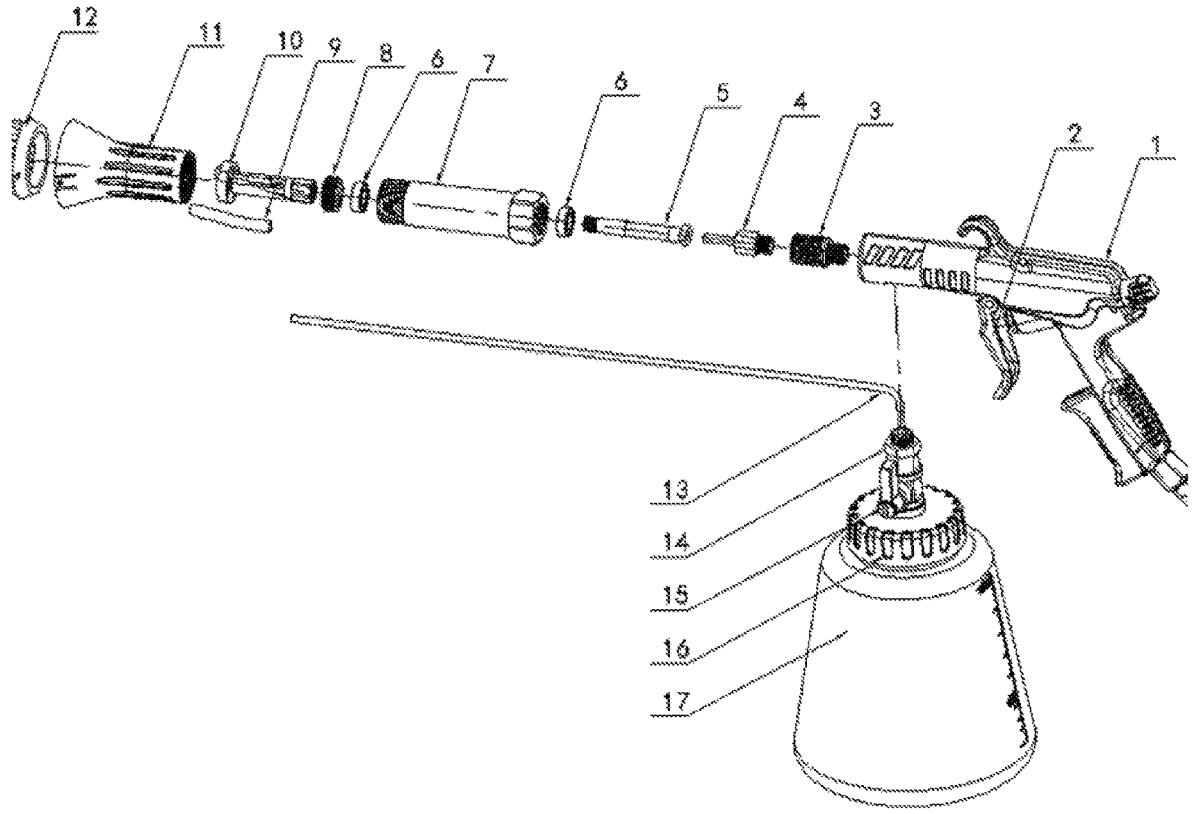
FIG. 3 is a schematic diagram of a breakdown structure of the utility model.
Figure 4:
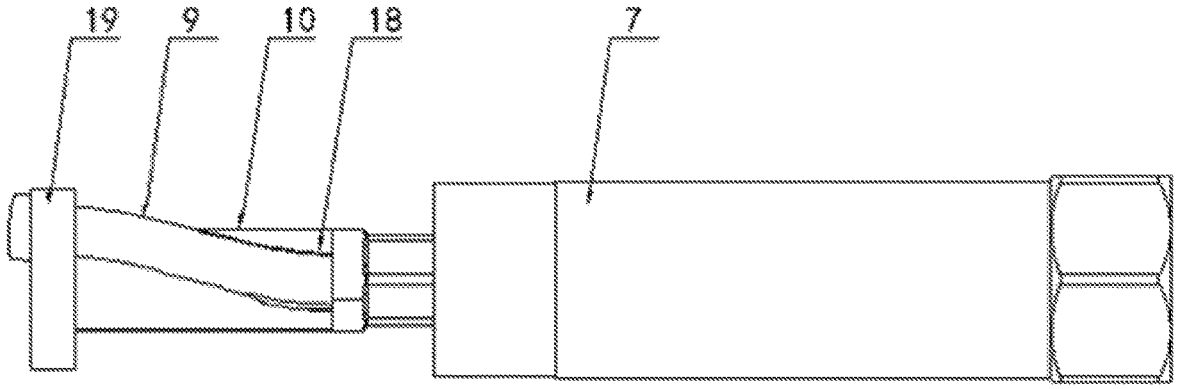
FIG. 4 is a schematic diagram of a main structure of a rotating spray apparatus of the utility model.
Figure 5:
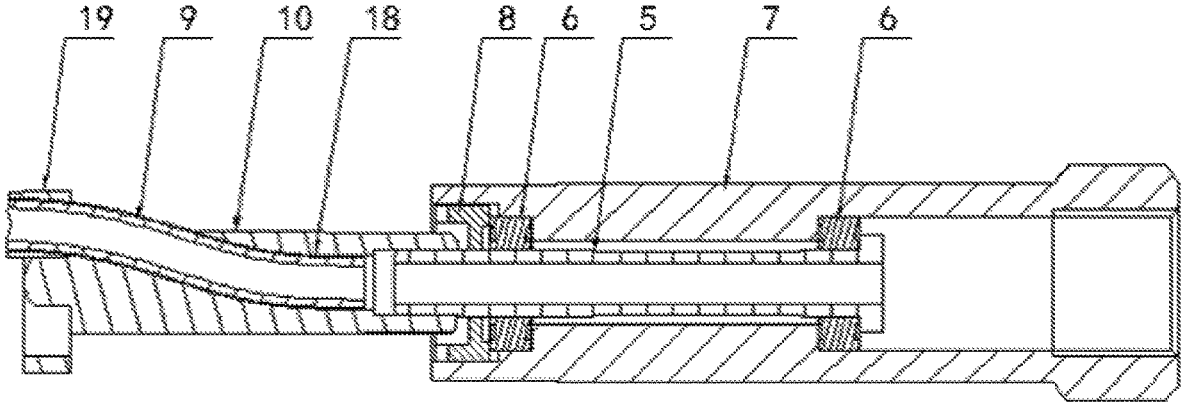
FIG. 5 is a schematic diagram of a matching structure of a rotating spray apparatus of the utility model.
Figure 6:
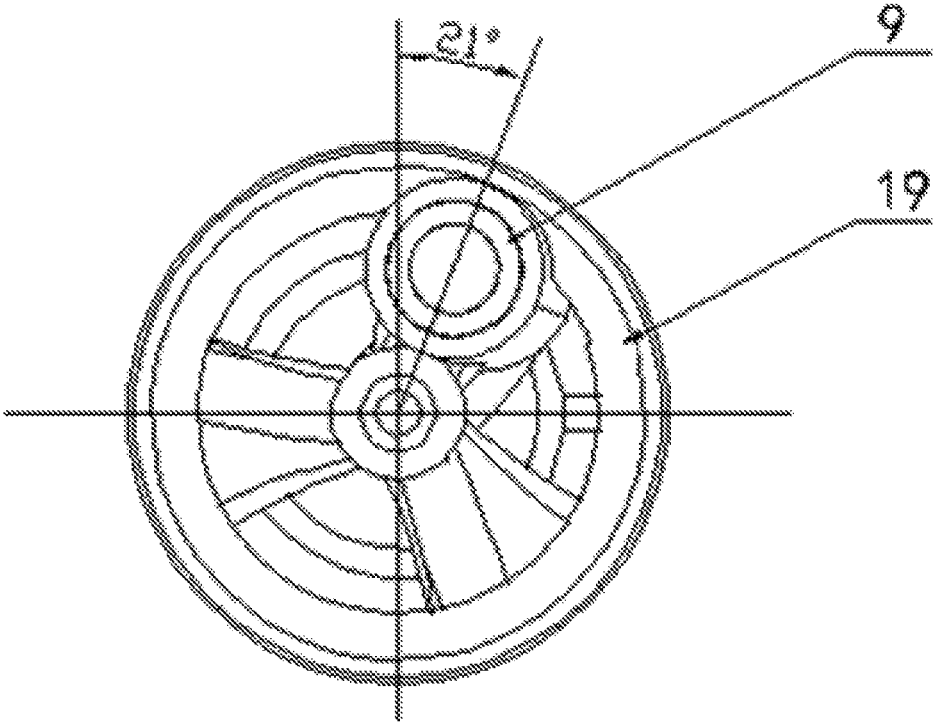
FIG. 6 is a schematic diagram of a left structure of a rotating spray apparatus of the utility model.

FIG. 1 to FIG. 6 show specific implementation solutions of a dual-purpose rotating spray gun for dust removal and cleaning in the utility model. The dual-purpose rotating spray gun for dust removal and cleaning comprises a gun body 1, a trigger switch 2, a pot body assembly and a rotating spray apparatus. An air passage inlet and an air passage outlet are formed in the gun body 1. An air inlet connector is fixed on the air passage inlet. The trigger switch 2 can turn on an air passage or turn off the air passage. The rotating spray apparatus comprises a bidirectional connector 3, a spray nozzle 4, a connecting sheath 7, a hollow rotating shaft 5, a rotating spray head 10, a spray pipe 9 and a cleaning solution suction pipe 13. One end of the bidirectional connector 3 is fixed to the air passage outlet of the gun body 1, and the other end is fixedly connected with the connecting sheath 7. The hollow rotating shaft 5 is rotatably arranged in the connecting sheath 7 through the bearings 6. One end of the hollow rotating shaft 5 is provided with a retaining ring which is used for compressing the bearing 6, and the bearing 6 on the other end of the hollow rotating shaft 5 is fixed through a compression nut 8 fixed to the connecting sheath 7, thereby ensuring smooth and flexible rotation of the hollow rotating shaft 5. The spray nozzle 4 is fixed to an outlet of the bidirectional connector 3. The spray head of the spray nozzle 4 is inserted into the hollow rotating shaft 5. The rotating spray head 10 is fixed to the hollow rotating shaft 5 and is provided with a rotating spray track 18. The spray pipe 9 is fixed to the rotating spray track 18. An inlet of the spray pipe 9 is communicated with the hollow rotating shaft 5. An outlet of the spray pipe 5 is positioned on an outer end surface of the rotating spray head 10. The spray pipe 9, the hollow rotating shaft 5 and the spray nozzle 4 form a spray air passage. The cleaning solution suction pipe 13 is arranged in the spray pipe 9, penetrates through the hollow rotating shaft 5 and the spray nozzle 4 and is connected with a housing assembly.

To ensure stable rotation and convenient dust removal and cleaning during operation, a cleaning connector 11 sleeved on the rotating spray head 10 is fixed to the connecting sheath 7; and the end surface of the rotating spray head 10 is provided with a synchronously rotating fan structure 19. The fan structure 19 can further enhance an atomization effect during cleaning, and can improve operating environments during dust removal. The cleaning connector 11 is a horn-shaped connector, and a brush 12 is fixed to the horn-shaped connector. An angle at which a connecting line between a center extension line of an inlet end of the spray pipe 9 and a center of an outlet end of the spray pipe 9 deviates from a vertical line is controlled between 16 degrees and 26 degrees.

For convenient use, the pot body assembly comprises a pot body 17, a pot cover 16 fixed to the pot body 17, a valve 15 and a suction pipe connector 14; one end of the valve 15 is fixedly connected with an air passage of the gun body 1 through the suction pipe connector 14; and the other end is fixed to the pot cover 16 and is connected with a weighted dip tube 20.

When the utility model is used for dust removal, the valve 15 is turned off; the trigger switch 2 is flipped; compressed air is outputted from the air passage of the gun body 1 and sprayed out of the spray pipe 9 through the spray air passage formed by the spray nozzle 4, the hollow rotating shaft 5 and the spray pipe 9; and the spray pipe 9 under the action of the sprayed compressed air drives the rotating spray head 10 and the hollow rotating shaft 5 to rotate rapidly, thereby achieving the purpose of blowing dust.

When the utility model is used for cleaning, a cleaning solution is disposed in the pot body 17; the valve 15 is turned on; the trigger switch 2 is flipped; the compressed air is outputted from the air passage of the gun body 1 and sprayed out of the spray pipe 9 through the spray air passage formed by the spray nozzle 4, the hollow rotating shaft 5 and the spray pipe 9; negative pressure is generated at the outlet of the cleaning solution suction pipe 13; the negative pressure sucks out the cleaning solution in the pot body 17, and the sucked cleaning solution is mixed with the compressed air sprayed by the spray pipe 9 and sprayed out in a form of mist; the rotating spray head 10 and the hollow rotating shaft 5 rotate rapidly under the drive of the sprayed compressed air during spraying; and a mist-shaped mixed air flow is accurately sprayed to a to-be-decontaminated operation surface in a spiral form for friction and cleaning, thereby achieving the purpose of quick decontamination.

The above contents are further descriptions of the utility model in combination with specific embodiments. For those ordinary skilled in the art to which the utility model belongs, several simple deductions and replacements may be made without departing from the conception of the utility model, all of which shall be considered to belong to the protection scope of the utility model.

The invention claimed is:

1. A dual-purpose rotating spray gun for dust removal and cleaning, comprising a gun body (1), a trigger switch (2), a pot body assembly and a rotating spray apparatus, wherein the rotating spray apparatus comprises a bidirectional connector (3), a spray nozzle (4), a connecting sheath (7), a hollow rotating shaft (5), a rotating spray head (10), a spray pipe (9) and a cleaning solution suction pipe (13); one end of the bidirectional connector (3) is fixed to an air passage outlet of the gun body (1); the other end is fixed to the connecting sheath (7); the hollow rotating shaft (5) is rotatably arranged in the connecting sheath (7); the spray nozzle (4) is fixed to an outlet of the bidirectional connector (3); the spray head of the spray nozzle (4) is matched with the hollow rotating shaft (5); the rotating spray head (10) is fixed to the hollow rotating shaft (5) and is provided with a rotating spray track (18); the spray pipe (9) is fixed to the rotating spray track (18); an inlet of the spray pipe (9) is communicated with the hollow rotating shaft (5); an outlet of the spray pipe (5) is positioned on an outer end surface of the rotating spray head (10); and the cleaning solution suction pipe (13) is arranged in the spray pipe (9), penetrates through the hollow rotating shaft (5) and the spray nozzle (4) and is connected with a housing assembly.

2. The dual-purpose rotating spray gun for dust removal and cleaning according to claim 1, wherein a cleaning connector (11) sleeved on the rotating spray head (10) is fixed to the connecting sheath (7); and the end surface of the rotating spray head (10) is provided with a synchronously rotating fan structure (19).

3. The dual-purpose rotating spray gun for dust removal and cleaning according to claim 1, wherein an angle at which a connecting line between a center extension line of an inlet end of the spray pipe (9) and a center of an outlet end of the spray pipe (9) deviates from a vertical line is controlled between 16 degrees and 26 degrees.

4. The dual-purpose rotating spray gun for dust removal and cleaning according to claim 2, wherein the cleaning connector (11) is a horn-shaped connector, and a brush (12) is fixed to the horn-shaped connector.

5. The dual-purpose rotating spray gun for dust removal and cleaning according to claim 1, wherein bearings (6) are correspondingly arranged on both ends of the hollow rotating shaft (5); one end of the hollow rotating shaft (5) is provided with a retaining ring which is used for compressing the bearing (6); and the bearing (6) on the other end of the hollow rotating shaft (5) is fixed through a compression nut (8) fixed to the connecting sheath (7).

6. The dual-purpose rotating spray gun for dust removal and cleaning according to claim 5, wherein the pot body assembly comprises a pot body (17), a pot cover (16) fixed to the pot body (17), a valve (15) and a suction pipe connector (14); one end of the valve (15) is fixedly connected with an air passage of the gun body (1) through the suction pipe connector (14); and the other end is fixed to the pot cover (16) and is connected with a weighted dip tube (20).

7. The dual-purpose rotating spray gun for dust removal and cleaning according to claim 2, wherein bearings (6) are correspondingly arranged on both ends of the hollow rotating shaft (5); one end of the hollow rotating shaft (5) is provided with a retaining ring which is used for compressing the bearing (6); and the bearing (6) on the other end of the hollow rotating shaft (5) is fixed through a compression nut (8) fixed to the connecting sheath (7).

8. The dual-purpose rotating spray gun for dust removal and cleaning according to claim 3, wherein bearings (6) are correspondingly arranged on both ends of the hollow rotating shaft (5); one end of the hollow rotating shaft (5) is provided with a retaining ring which is used for compressing the bearing (6); and the bearing (6) on the other end of the hollow rotating shaft (5) is fixed through a compression nut (8) fixed to the connecting sheath (7).

9. The dual-purpose rotating spray gun for dust removal and cleaning according to claim 4, wherein bearings (6) are correspondingly arranged on both ends of the hollow rotating shaft (5); one end of the hollow rotating shaft (5) is provided with a retaining ring which is used for compressing the bearing (6); and the bearing (6) on the other end of the hollow rotating shaft (5) is fixed through a compression nut (8) fixed to the connecting sheath (7).

* * * * *